United States Patent [19]

Pinckaers

[11] 4,382,770

[45] May 10, 1983

[54] SAFE START FUEL BURNER CONTROL SYSTEM

[75] Inventor: B. Hubert Pinckaers, Edina, Minn.

[73] Assignee: Honeywell Inc., Minneapolis, Minn.

[21] Appl. No.: 199,404

[22] Filed: Oct. 22, 1980

[51] Int. Cl.[3] ..... F23Q 23/00

[52] U.S. Cl. ..... 431/26; 431/18; 431/24; 431/69

[58] Field of Search ..... 431/26, 24, 18, 69; 340/410

[56] References Cited

U.S. PATENT DOCUMENTS

| | | | |
|---|---|---|---|
| 2,748,845 | 6/1956 | Marshall et al. | 431/26 |
| 3,023,803 | 3/1962 | Deziel | 431/26 |
| 3,202,976 | 8/1965 | Rowell . | |
| 3,286,761 | 11/1966 | Engh . | |
| 3,619,097 | 11/1971 | Clay et al. . | |
| 4,078,878 | 3/1978 | Barbour et al. . | |
| 4,168,949 | 9/1979 | Hamelink et al. . | |
| 4,226,581 | 10/1980 | Schilling | 431/26 |
| 4,230,444 | 10/1980 | Matthews | 431/26 X |

FOREIGN PATENT DOCUMENTS

| | | | |
|---|---|---|---|
| 55-41387 | 3/1980 | Japan | 431/26 |

*Primary Examiner*—Larry Jones

*Attorney, Agent, or Firm*—Alfred N. Feldman

[57] ABSTRACT

An intermittent gas pilot system utilizing a flame signal simulating circuit means provides for both dynamic as well as static safe start checking for the system. A simulated flame signal is provided so that the relays contained within the system must be checked dynamically before the system will allow the opening of the main gas valve.

6 Claims, 2 Drawing Figures

SAFE START FUEL BURNER CONTROL SYSTEM

BACKGROUND OF THE INVENTION

In recent years, due to the high cost of fuel and the need for energy conservation, the long established standing pilot for gas fired burner equipment has decreased in favor. In some states the use of standing pilots for gas fired equipment has been restricted or eliminated by statute. The conventional standing pilot was an exceedingly inexpensive and safe type of device when the pilot was linked to its related gas valve by a simple pilot safety system.

The conventional standing pilot for gas fired equipment has been replaced by intermittent pilot systems utilizing a spark generator to ignite a pilot flame, which in turn is used to ignite the main burner. This type of equipment typically relies on a spark generator and two sequentially opened gas valves. The smaller of the gas valves is normally referred to as the pilot valve and provides a fuel to a pilot burner which is ignited by a spark source. The spark source can be a small, high voltage alternating current transformer, or more typically is a relaxation type of oscillator utilizing a silicon controlled rectifier, capacitor and step-up transformer. Once the pilot has been ignited, a flame sensor allows for the energization of a main valve solenoid which then supplies fuel gas to the main burner. The main burner is then ignited from the pilot. This type of equipment, normally electronic in nature, is subject to many types of failures. As a result of this, a great deal of design effort has been expended in producing solid state control systems and spark generators which have a high degree of safety and reliability. Most of the equipment of this type has relied upon redundant electronics, and static safe start check operations of the electromechanical relays which are normally used for control of the pilot valve and the main gas valve.

SUMMARY OF THE INVENTION

The present invention is directed to an improvement of devices which are generally referred to as intermittent pilot gas burner ignition systems. These systems typically perform a safe start check of a static type, and then open the main gas valve after the pilot flame has been proved by a flame detector means. The present invention extends the safety of the prior art devices by providing a dynamic safe start check for this same equipment. The dynamic safe start check is provided by simulating a flame signal at the start up of the device. The simulated flame signal causes an immediate pull in of the first relay in the device. The relay is maintained in an energized state while a second relay is set up or conditioned to pull in immediately. The conditioning is provided by a thermal time delay circuit or by other relay circuits. The first relay is then allowed to momentarily drop out and a normal start up of the device then proceeds.

The present dynamic safe start check relies on the simulation of a flame at start up by the application of a voltage at the output of the flame sensor and by the conditioning of the second relay in response to this action. This assures a proper pull in of the relays and eliminates any possibility of a relay race occurring between the two relays that operate the pilot valve and the main valve for the burner control system.

DESCRIPTION OF THE PREFERRED EMBODIMENTS

Figure 1:
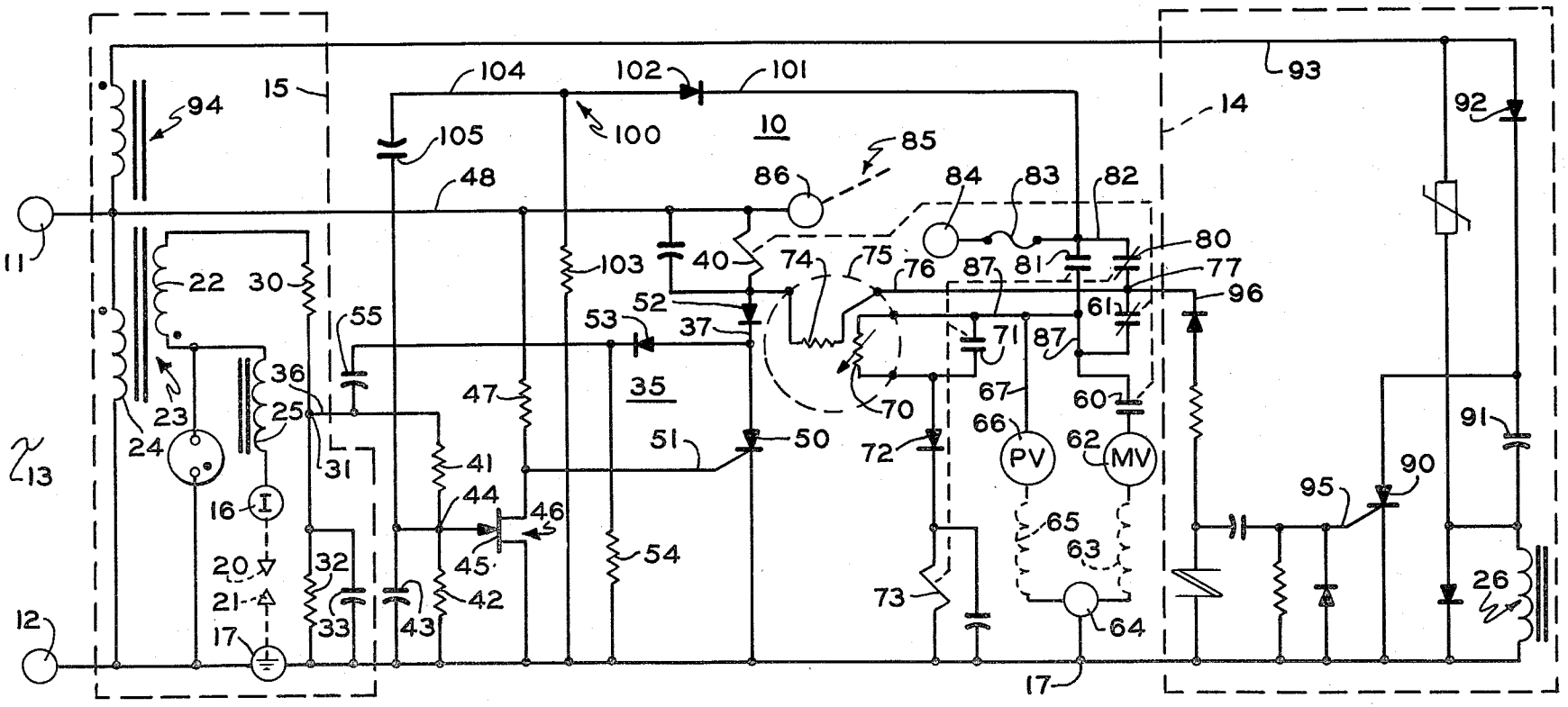
FIG. 1 is a complete schematic diagram of an intermittent gas pilot control system having both static and dynamic safe start check functions.

In FIG. 1 a complete schematic circuit diagram of an intermittent gas pilot system is disclosed at 10. The system is energized at a pair of terminals 11 and 12 from a voltage source disclosed at 13. The voltage source 13 typically would be a low voltage alternating current potential. In most residential control applications this voltage source would be in a range of 24 to 28 volts.

The intermittent gas pilot system 10 would include an ignition means 14 which has been disclosed as a conventional relaxation oscillator type of capacitor discharge ignition means. The ignition means 14 can be any type of ignition means that is capable of igniting gas at a pilot burner. The details of a typical ignition means 14 will be described in more detail later. The intermittent gas pilot system 10 further has a combined spark electrode and flame sensing section disclosed at 15. The combined spark generation electrodes and flame sensing electrodes are connected between a pair of terminals 16 and the ground terminal 17. The combined spark electrode and flame sensing section 15 will be described in some detail in connection with the operation of the intermittent gas pilot system 10, but for a complete and detailed explanation of how this portion of the circuit works reference is made to application Ser. No. 58,423 filed on July 20, 1979 in the name of R. A. Schilling. That application is assigned to the assignee of the present invention. At this point it is sufficient to indicate that electrodes connected between the terminal 16 and the ground terminal 17 cooperate with the ignition means 14 to generate a spark between a pair of electrodes generally disclosed at 20 and 21. This same pair of electrodes senses the existence of a flame between the electrodes 20 and 21 by means of a flame rectification principle in response to a voltage from a transformer secondary 22 which is part of a step-up transformer 23 along with a primary winding 24. The secondary winding 22 is connected in series with a further winding 25 which is the high voltage secondary of the ignition transformer generally disclosed at 26, which is part of the ignition means 14. The presence of a voltage from the secondary winding 22 is applied across a resistor 30 to a junction 31 and a further resistor 32 and capacitor 33 to the ground 17. The presence of a flame across the electrodes 20 and 21 causes a (negative) potential to be present at the junction 31, and the potential at junction 31 is used for control of the pilot valve or pilot gas source means of the burner controlled by the intermittent gas pilot system 10. The elements described including the transformer secondary 22, the secondary winding 25, the electrodes 20 and 21, and the voltage output at the junction 31 form a flame detector means and a flame detection circuit means having an output voltage at junction 31 which is responsive to the presence of a flame at the flame detector means.

A solid state amplifying and switching means is generally disclosed at 35 and it has an input on conductor 36 which is connected to junction 31, and an output at the conductor 37 which is connected to control a first relay 40. The input conductor 36 of the solid state switching means 35 is connected to a voltage divider including the resistors 41 and 42 along with the capacitor 43 that provides an input voltage source at 44 to the gate 45 of a field effect transistor generally disclosed at 46. The field effect transistor is connected between the ground 17 and a resistor 47 to a source of potential 48 which is in turn connected to the terminal 11 for the device. The output of the solid state switching means 35 includes a silicon controlled rectifier 50 which has a gate 51 connected to the field effect transistor 46. The gate 51 is either shorted by the field effect transistor 46 or is allowed to be operatively controlled by a voltage developed through the resistor 47 from the potential 48 when the field effect transistor 46 is not conducting. The silicon controlled rectifier 50 is further connected between the ground 17 and the output conductor 37 of the solid state switching means 35 so that the silicon controlled rectifier 50 can energize the relay 40 through a diode 52 when the silicon controlled rectifier 50 is conducting. The solid state switching means 35 further includes a further diode 53 and a bleed resistor 54, along with a capactor 35 which ensures the proper operation of the solid state switching means 35.

The relay 40 is connected to operate a pair of relay contacts 60 and 61 which are disclosed as a normally open and a normally closed pair of contacts which are operated in a conventional manner by the relay 40 upon its operation. The normally open contact 60 is connected to a terminal 62 which is adapted to be connected to the main gas valve 63 so that it in turn can be connected to the ground 17 which has been shown as a further terminal 64. The terminal 64 is adapted to be connected through a pilot valve 65 that is in turn connected to a terminal 66 within the intermittent gas pilot system 10. The terminal 66 is connected by a conductor 67 to a parallel combination of a negative temperature coefficient resistor 70 and a normally open relay contact 71. The parallel combination of a negative temperature coefficient resistor 70 and the relay contact 71 are connected through a diode 72 to a second relay 73 which operates the normally open relay contact 71. The relay 73 is then connected to ground 17 so that energy flowing through the diode 72 is capable of energizing the relay 73 when either the contact 71 is closed or when the resistance of the negative temperature coefficient resistor 70 is low under the influence of a heater. The heater is disclosed at 74 and is enclosed in a package 75 so that the heat from the heater 74 is applied to negative temperature coefficient resistor 70 to reduce its value in the initial operation of the relay 73, as will be described later. The heater 74 is connected to the diode 52 and to a conductor 76 that is connected to a common point 77 at one side of the normally closed contact 61. The common point 77 is connected through a normally closed relay contact 80 that is operated along with a normally open relay contact 81 by the relay 73. The relay contacts 80 and 81 have a common conductor 82 to one side of the contacts, and this conductor is connected through a fuse 83 to a terminal 84. The terminal 84 acts with a power switch means disclosed at 85 connected to a terminal 86. The power switch means 85 can be a manually operated switch, but in most systems would be a conventional thermostat. When the switch means 85 is closed power is supplied from conductor 48 through the terminal 86 to the terminal 84 and through the fuse 83 to the conductor 82. The interconnection of the normally open and normally closed relay contacts 60, 61, 80, and 81 is completed by a conductor 87 so that electrical power can be appropriately routed to the relay 73 and the pilot valve 65, along with the main valve 63.

To this point the first and second relay circuit means and their associated normally open and normally closed contacts have been described. The negative temperature coefficient resistor 70 and its heater 74 in the package 75 form part of a relay conditioning circuit means which are required to condition the relay 73 before it can initially be pulled in. This function will be described in detail when the description of the operation of the device is provided.

The ignition means 14 has been briefly referred to in the introductory portion of the present description. The ignition means 14 includes a silicon controlled rectifier 90 and a power capacitor 91 that is charged through a diode 92 from a conductor 93 and a transformer generally disclosed at 94. The silicon controlled rectifier 90 is gated at 95 to periodically discharge the capacitor 91 through the transformer 26 to generate a high voltage across the secondary winding 25 to generate a spark across the electrodes 20 and 21. The ignition means 14 will not be described in further detail as it is conventional and could be replaced by a conventional copper-iron transformer. The only further comment necessary is that the gating potential is derived from a conductor 96 that is connected to the junction 77. This provides for turning off the ignitor when flame is detected during the burner "on" period.

The present intermittent gas pilot system 10 is completed by the provision for a flame signal simulating circuit which is generally disclosed at 100. This includes the conductor 101, a diode 102, and a resistor 103 that is connected between a further conductor 104 and the ground 17. The conductor 104 is connected through a capacitor 105 to the junction 44 between the gate 45 of the field effect transistor 46 and one side of the capacitor 43. The flame signal simulating circuit function will be described in some detail, but briefly this circuit allows for the application of a potential at junction 44 when the system is initially started that simulates the existence of a flame when none in fact exists. Due to the resistor 42 connected across the capacitor 43 of the flame signal simulating circuit means 100, the voltage on capacitor 43 disappears or discharges after a short period of flame simulation time and the system is put in to a normal operating state if all of the components check out.

OPERATION OF FIG. 1

In a typical application for the intermittent gas pilot system 10, power is supplied to the terminals 11 and 12 and the switch or thermostat 85 is open. The terminals 62, 66, and 64 are connected to the pilot valve 65 and the main valve 63 of the fuel burner (which has not been shown in structural detail). A pair of electrodes 20 and 21 are connected between the terminal 16 and ground 17 for the application of a spark at the pilot burner for the system, and for sensing the existence of a flame by way of flame rectification as has been previously mentioned. The appliction of potential to the terminals 11 and 12 supplies a potential to the terminal 86 and the ground 17. The relay 40 stays deenergized as the silicon controlled rectifier 50 cannot conduct because the field effect transistor 46 is in a conducting state between the conductor 48 and the ground 17. At this same time there is not controlling potential at the junction 77 for the ignition means 14 and the ignition means is inoperative. This is the normal standby condition for the burner, and the intermittent gas pilot system 10 is ready to initiate and monitor a flame at a fuel burner upon the closing of the switch means or thermostat 85. When the switch means 85 is closed a potential is supplied immediately through the fuse 83 so that the flame simulating circuit means 100 can draw current through the diode 102 to charge the capacitor 43 with a potential that causes the field effect transistor 46 to cease conducting. This immmediately raises the potential on the gate 51 to a voltage determined by the value of the resistance 47 and the potential on the conductor 48. The silicon controlled rectifier 50 is immediately driven into conduction and the relay 40 operates its contacts 60 and 61. The contact 61 opens and removes any possible energizing path through the various relay contacts to the main valve 63 and the pilot valve 65.

At the time that the switch means or thermostat 85 closes, a circuit is provided through the fuse 83, the conductor 82 and the normally closed relay contact 80 to the conductor 76 so that current begins to flow through the heater 74, the diode 52, and the silicon controlled rectifier 50. This begins a heating cycle for the heater 74 that in turn begins to reduce the value of a negative temperature coefficient resistor 70. The negative temperature coefficient resistor 70 is selected so that its cold value in series with the relay 73 is sufficient to prevent the relay 73 from pulling in if voltage had been supplied to the conductor 87 inadvertently calling for the operation of the relay 73. Under these start up conditions the relay 40 pulls in immediately under the influence of the flame signal simulating circuit means 100. This immediate operation of the relay 40 is accompanied by the energization of the relay conditioning circuit means which includes the heater 74. The heater 74 conditions the negative temperature coefficient resistor 70 so that the second relay 73 can be pulled in when voltage is subsequently applied to the conductor 87.

After a brief interval of time, this time being dictated by the value of the capacitor 43 and 105 and the shunt resistance 42, the voltae at the junction 44 has decayed to a point where the field effect transistor 46 begins to conduct. The conduction of the field effect transistor 46 shorts out the gate 51 of the silicon controlled rectifier 50 and the relay 40 is denergized. Since the switch means or thermostat 85 is still closed, the deenergization of the relay 40 causes an energizing path to exist through the normally closed contact 80 and the now closed contact 61 to the conductor 87 where power is supplied to the pilot valve 65 so that the pilot valve opens supplying gas to the pilot burner. At this same time the ignition means 14 is activated to generate a spark across the electrodes 20 and 21. The contact 60 is open thereby insuring that the main valve cannot open until the relay 40 has once again been energized. The relay 40 will not be reenergized until a flame rectification current builds up a potential across the capacitor 43 at the gate 45 of the field effect transistor 46. When the voltage at the gate 45 is sufficiently high, the field effect transistor 46 ceases to conduct and the silicon controlled rectifier is allowed to energize the relay 40 in much the same manner as was provided when the flame signal simulating circuit provided a voltage to the gate 45 of the field effect transistor 46. However, at this time prior to the reenergization of relay 40 the relay 73 has been conditioned by the reduction in the value of the negative temperature coefficient resistor 70 so that the relay 73 can be pulled in by current flowing through the normally closed contact 61, the conductor 87, the resistor 70, the diode 72, and the relay 73. When the relay 73 is energized, it closes a latching contact 71 that shorts out the negative temperature coefficient resistor 70 insuring that the relay 73 will remain energized. At this same time the relay contact 81 has closed which connects the relay 73 directly to the switch means or thermostat 85 so that a constant source of potential is available to the relay 73 to hold it energized. This action also completes a circuit through the conductor 87 directly to contact 60, so that when subsequently the pilot flame is detected and relay contact 60 closes the main gas valve is energized and the main burner comes "on". The system is now in the "on" state.

This is the normal operation of the device. The circuit of the intermittent gas pilot system 10 initially contained all of the normal static safe start check circuitry typically used in this type of equipment. The addition of the flame signal simulating circuit means 100, however, caused the relay 40 to be cycled in a dynamic fashion checking the relay structure and the relay contacts 60, 61, and the associated energizing circuit for the relay 73 which was conditioned by the heating of the resistive heater 74 to change the value of the negative temperature coefficient resistor 70. The change in the resistor value of the negative temperature coefficient resistor 70 is essential to pull in the relay 73. Functionally the operation of the device provides for a false flame signal to the relay 40 so that the relay 40 pulls in. The relay 40, when in a pulled in condition, allows the conditioning of the relay 73 so that it is capable of being pulled in. The relay 40 is then allowed to drop out momentarily and a normal safe start up is initiated for the system. The short application of the flame signal simulating voltage and the need to condition the second relay 73 prior to its possible energization provides for a safe start check of both a static and a dynamic type. The dynamic check guards against unsafe failures (which show up when there is a line voltage interruption or ignition giving a false flame signal) which are not always detected by the static safe start circuits.

Figure 2:
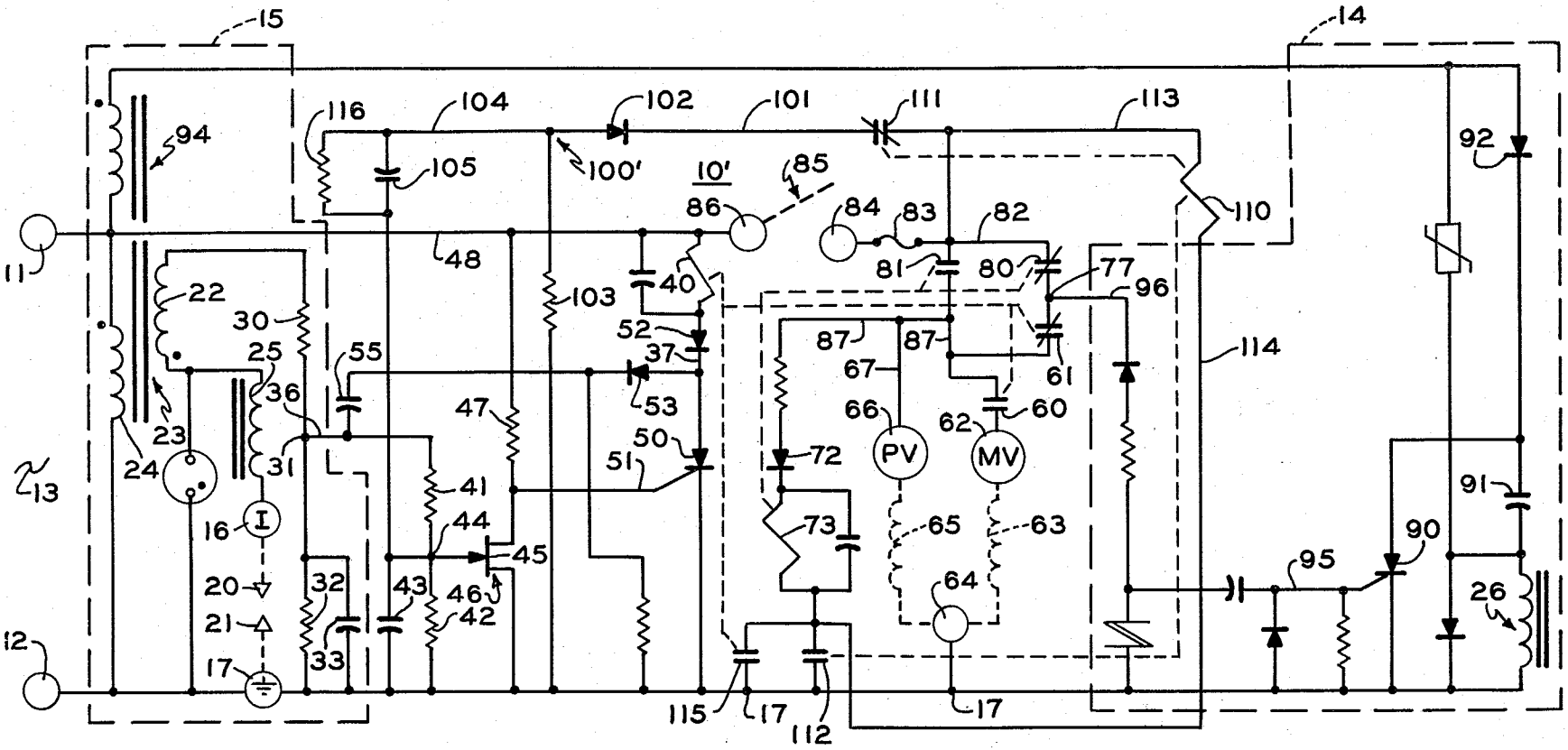
FIG. 2 is similar to FIG. 1 except for the relay conditioning circuitry.

In FIG. 2 a very similar intermittent gas pilot system has been disclosed at 10'. Much of the circuitry is the same as that described in connection with FIG. 1 and will not be repeated at this point. Only the circuit differences will be enumerated. The intermittent gas pilot system 10' includes a different type of relay conditioning circuit means than is disclosed in FIG. 1. In FIG. 1 the relay conditioning circuit means utilized a heater and a negative temperature coefficient resistor whereas the present circuit utilizes a third relay disclosed at 110. The relay 110 has a normally closed contact 111 and a normally open contact 112. The relay 110 is connected between the conductor 82 and the normally closed contact 111 by the conductor 113. The other side of the relay 110 is connected by a conductor 114 to the lower end of the relay 73. In this particular case the relay contact 112 is placed between the lower end of the relay 73 and the ground 17. It is also paralleled by a normally open contact 115 that is operated by relay 40.

In addition to the changes in the relay conditioning circuit means, a modified flame signal simulating circuit means 100' has been disclosed. The flame signal simulating circuit 100' is modified slightly by the addition of a bleed resistor 116 that is connected across the capacitor 105 and further includes the normally closed relay contact 111 that is operated by the relay 110. It should be noted that the contact 111 and the bleed resistor 114 are not necessary but provide for an additional function that will be noted below. The flame signal simulating circuit means 100 could be used in FIG. 2 as it was in FIG. 1.

OPERATION OF FIG. 2

The operation of FIG. 2 is substantially the same as that of FIG. 1 except for the flame signal simulating circuit and the relay conditioning circuit means. The relay condition circuit means for the relay 73 is kept from being energized by the normally open relay contacts 112 and 115. Upon the closing of a switch means or thermostat 85 the relay 110 is energized from the conductor 82, 113, 114, and the contact 115 which is initially operated by the relay 40 under the influence of the flame signal simulating circuit means 100'. Once the relay 110 operates, it parallels the contact 112 with the contact 115 thereby allowing relay 73 to remain energized when relay 40 is subsequently deenergized and its contact 115 opens. The balance of the cycle is of the same as that in FIG. 1.

In connection with the flame signal simulating circuit 100', the operation of the relay 110 opens the normally closed contact 111 so that the capacitor 43 and the capacitor 105 can obtain no further charge. The capacitor 105 is slowly discharged by the resistor 116 thereby conditioning the flame signal simulating circuit 100' for a repeated operation immediately, if needed. For example if, just then, a supply voltage interruption occurs.

It is quite apparent from the two Figures disclosed that the intermittent gas pilot systems 10 and 10' have been provided with a flame signal simulating circuit that causes a dynamic checking of the relay means for the system. The systems also show two different types of flame simulating circuit means and two different types of relay conditioning means. The first relay conditioning means utilizes a time delay of the thermal type while the second utilizes a relay contact interlock configuration. The invention contained in the present circuitry can be modified in many ways to obtain the flame signal simulating circuit means and the necessary relay conditioning circuit means. As such, the applicant wishes to be limited in the scope of his invention solely by the scope of the appended claims.

The embodiments of the invention in which an exclusive property or right is claimed are defined as follows:

1. A fuel burner control system for a gas fuel burner having pilot gas source means, main burner gas source means, ignition means for the pilot gas source means, and power switch means adapted to initiate operation of said control system from a voltage source, including: flame detector means and flame detection circuit means having a voltage output in response to the presence of a flame at said flame detector means; solid state switching means having an input responsive to said flame detection circuit means, and having an output connected to control first relay means; said relay means having normally open contacts and normally closed contacts; flame signal simulating circuit means responsive to the application of said voltage source to said system upon said power switch closing to provide a brief false flame signal voltage to said solid state switching means to simulate a flame at said flame detector means thereby energizing said first relay means; second relay means having normally open contacts and normally closed contacts; relay conditioning circuit means responsive to the application of said voltage source upon the closing of said power switch means to condition said second relay means to immediately operate after said first relay means completes an operating cycle responsive to said false flame signal voltage; said relay conditioning circuit means including thermal time delay means having a negative temperature coefficient resistance in series with said second relay means; a heater for said negative temperature coefficient resistance energized upon the closing of said power switch means; and relay contact interconnection means connecting said relay contacts to said ignition means, said pilot gas source means, and said main burner gas source means to safely operate said fuel burner; said safe operation requiring that said false flame signal voltage cause said solid state switch means to condition said second relay means to operate after said false signal is removed and a further flame signal is received.

2. A fuel burner control system as described in claim 1 wherein said flame signal simulating circuit means includes capacitor means having discharge path means with said capacitor means being initially charged upon said power switch means closing to provide said brief false flame signal voltage.

3. A fuel burner control system as described in claim 2 wherein said capacitor means includes at least a pair of capacitors as a voltage divider; and said discharge path means including a resistor to discharge a first of said capacitors; said first capacitor charging to provide said brief false flame signal voltage.

4. A fuel burner control system as described in claim 3 wherein both said first and said second relay means include electromagnetic type relays.

5. A fuel burner control system as described in claim 4 wherein said solid state switch means includes a silicon controlled rectifier to in turn control said first relay; and said solid state switch means further including a field effect transistor responsive to the voltage across said first capacitor.

6. A fuel burner control system as described in claim 5 wherein said second relay includes a normally open contact in parallel with said negative temperature coefficient resistor to short out said resistor upon operation of said second relay to latch said second relay into an energized state.

* * * * *